US005356140A

United States Patent [19]

Dabrowski et al.

[11] Patent Number: 5,356,140

[45] Date of Patent: Oct. 18, 1994

[54] DOUBLE POKER

[76] Inventors: Stanley P. Dabrowski; Mark Sincox, both of 8068 W. Sahara, Ste. C, Las Vegas, Nev. 89117

[21] Appl. No.: 47,715

[22] Filed: Apr. 14, 1993

[51] Int. Cl.[5] ..... A63F 1/00

[52] U.S. Cl. ..... 273/85 CP; 273/138 A; 273/274; 273/292; 273/85 G; 364/412

[58] Field of Search ..... 273/85 G, 85 CP, 292, 273/138 A, 274; 364/410–412

[56] References Cited

U.S. PATENT DOCUMENTS

| | | | |
|---|---|---|---|
| 4,743,022 | 5/1988 | Wood | 273/85 CP |
| 4,804,185 | 2/1989 | Noble et al. | 273/85 CP |
| 5,019,973 | 5/1991 | Wilcox et al. | 364/412 |
| 5,022,653 | 6/1991 | Suttle et al. | 273/85 CP |
| 5,042,818 | 8/1991 | Weingardt | 273/292 |
| 5,046,736 | 9/1991 | Bridgeman et al. | 273/85 G |
| 5,067,724 | 11/1991 | Rinkavage | 273/292 |
| 5,098,107 | 3/1992 | Boylan et al. | 273/292 |
| 5,224,706 | 7/1993 | Bridgeman et al. | 273/85 CP |

*Primary Examiner*—Jessica J. Harrison
*Assistant Examiner*—Kerry Owens
*Attorney, Agent, or Firm*—John Edward Roethel

[57] ABSTRACT

A player makes a wager to participate in the game and the player is dealt two distinct hands at the beginning of the game. Each hand is dealt from its own separate complete deck of cards. The player selects one of the hands to play and the unselected hand is voided or removed from use. The player plays out the selected hand according to the conventional manner of play of the game. The player wins or loses based on a payout schedule applied to preselected winning hand combinations and based on the number of coins wagered by the player. The game can be applied to any variation of draw poker, stud poker or Twenty-One. The game can be played in a live game version or an electronic video gaming machine can be programmed to display the game and provide the payouts to the player.

51 Claims, 5 Drawing Sheets

DOUBLE POKER

This invention relates to a poker game, and more particularly to a poker game in which the player has the option of choosing between a player's first hand dealt from a first deck of cards and a player's second hand dealt from a second distinct deck of cards.

BACKGROUND OF THE INVENTION

There have been many types of electronic video poker gaming machines that have been developed. Each electronic video poker gaming machine is designed to replicate the play of a hand of poker. Typically, the player is not playing against any other players or against a dealer's hand; the player is simply attempting to achieve the highest ranking poker hand possible from the cards displayed to the player. The higher the poker hand achieved by the player, the greater the player's winnings based on the number of coins wagered by the player.

The forerunner of all electronic video poker gaming machines is the video Draw Poker machine that deals cards from a standard 52 card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. A payout table is established based on the number of coins or tokens wagered by the player and the type of poker hand achieved.

Table 1 shows a typical payout schedule that is used in electronic video draw poker machines.

TABLE 1

| | | | | | |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

Based on theoretical probabilities, the payout table shown in Table 1 has a payback percentage of approximately 96%, which means that the gaming machine holds approximately 4%. The payback percentage can be adjusted up or down based on the profitability that the operator of the gaming machine desires and whatever regulations are imposed upon the operator by the gaming authority that regulates the use of the gaming machine.

The classic draw poker machine has been modified to use jokers as wild cards or to use deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved.

Other types of poker games have been adapted to run on electronic video gaming machines. In the electronic version of seven card stud poker, the player wagers one or more coins to be eligible to play the game and the player is dealt three cards initially. The player then has the option of folding in which case he loses his initial wager or betting additional coins to receive additional cards. Eventually the player has either folded or received a full seven card hand. The player wins or loses based on conventional poker hand rankings for the best five cards of his seven card hand. A payout table is established based on the number of coins or tokens wagered by the player and the type of poker hand achieved.

In the electronic version of five card stud poker, the player wagers one or more coins to be eligible to play the game and the player is dealt four cards initially. The player then has the option of staying or betting additional coins to increase the amount of a winning payout when he receives the fifth card. After the fifth card is dealt to the player, the value of his five card had is determined based on conventional poker hand rankings for his five card hand. A payout table is established based on the number of coins or tokens wagered by the player and the type of poker hand achieved.

Some of the card games adapted to electronic video gaming machines display both the player's hand and a dealer's hand. This occurs in those games where the player must beat the dealer in order to win.

In the electronic version of Twenty-One, the player is dealt two cards and the dealer is dealt two cards from a conventional deck of playing cards. Only one of the dealer's cards is exposed to the player. The player stands or hits based on the conventional manner of play of Twenty-One and dealer stands or hits as is conventional. The player wins if after the player has completed the play of his hand, the his hand totals more than the dealer's hand without going over the total of 21. If the player has a winning hand, he is paid one-to-one odds based on the amount of his wager. Blackjacks pay three-to-two odds and electronic Twenty-One gaming machines can be programmed to allow the player to perform conventional Twenty-One features such as doubling down, splitting pairs and taking insurance.

Because of the proliferation of legalized gaming, the competition for players has increased. Operators of gaming machines have been increasing the payback percentage to attract players and the increase of the gaming percentage has resulted in a lowering of profits to the operators. There is a demand in the market for new gaming machines that create a higher volume of play so that profits can be increased even with the higher payback percentages that the players desire.

In each of these electronic video gaming machines, the player receives a single hand to play from the electronic deck of cards. If the player receives an initial deal of poor cards, the player feels that his chances of winning are greatly reduced because the possibility of improving his hand through discarding and receiving replacement cards is not good. Because of the large number of combinations of the 52 playing cards of a standard deck taken five at a time, the chances of the player receiving poor cards in the initial deal are quite high.

If the electronic video gaming machine were programmed to deal to the player to distinct five card hands from two distinct decks of cards, the player would perceive that he has a better chance of winning. The player could select which of the two hands he desired to continue playing and the unselected hand would be removed from the video screen display.

It is an object of the present invention to provide a method of playing a card game in either a live game version or in an electronic gaming machine version that encourages a high amount of play while at the same time maintains acceptable payback percentages.

It is a feature of the present invention to provide a method of playing a card game in either a live game version or in an electronic gaming machine version in which the player is given two distinct hands from separate complete decks of cards. The player then chooses the one hand of the two that he wishes to play and the unselected hand becomes void or is removed from the screen display. The player plays out the selected hand in a conventional manner according to the rules of the game and wins or loses according to the posted payout schedule.

It is an advantage of the present invention that a higher amount of play is generated during a card game either in the live game version or on an electronic gaming machine, but the payback percentage is maintained at acceptable levels, thus generating increased profits to the operator of the gaming machine.

Other objects, features and advantages of the present invention will become apparent from a consideration of the following detailed description.

SUMMARY OF THE INVENTION

A player makes a wager to participate in the game and the player is dealt two distinct hands at the beginning of the game. Each hand is dealt from its own separate complete deck of cards. The player selects one of the hands to play and the unselected hand is voided or removed from use. The player plays out the selected hand according to the conventional manner of play of the game. The player wins or loses based on a payout schedule applied to preselected winning hand combinations and based on the number of coins wagered by the player. The game can be applied to any variation of draw poker, stud poker or Twenty-One. The game can be played in a live game version or an electronic video gaming machine can be programmed to display the game and provide the payouts to the player.

DETAILED DESCRIPTION OF THE PREFERRED EMBODIMENTS

Figure 1:
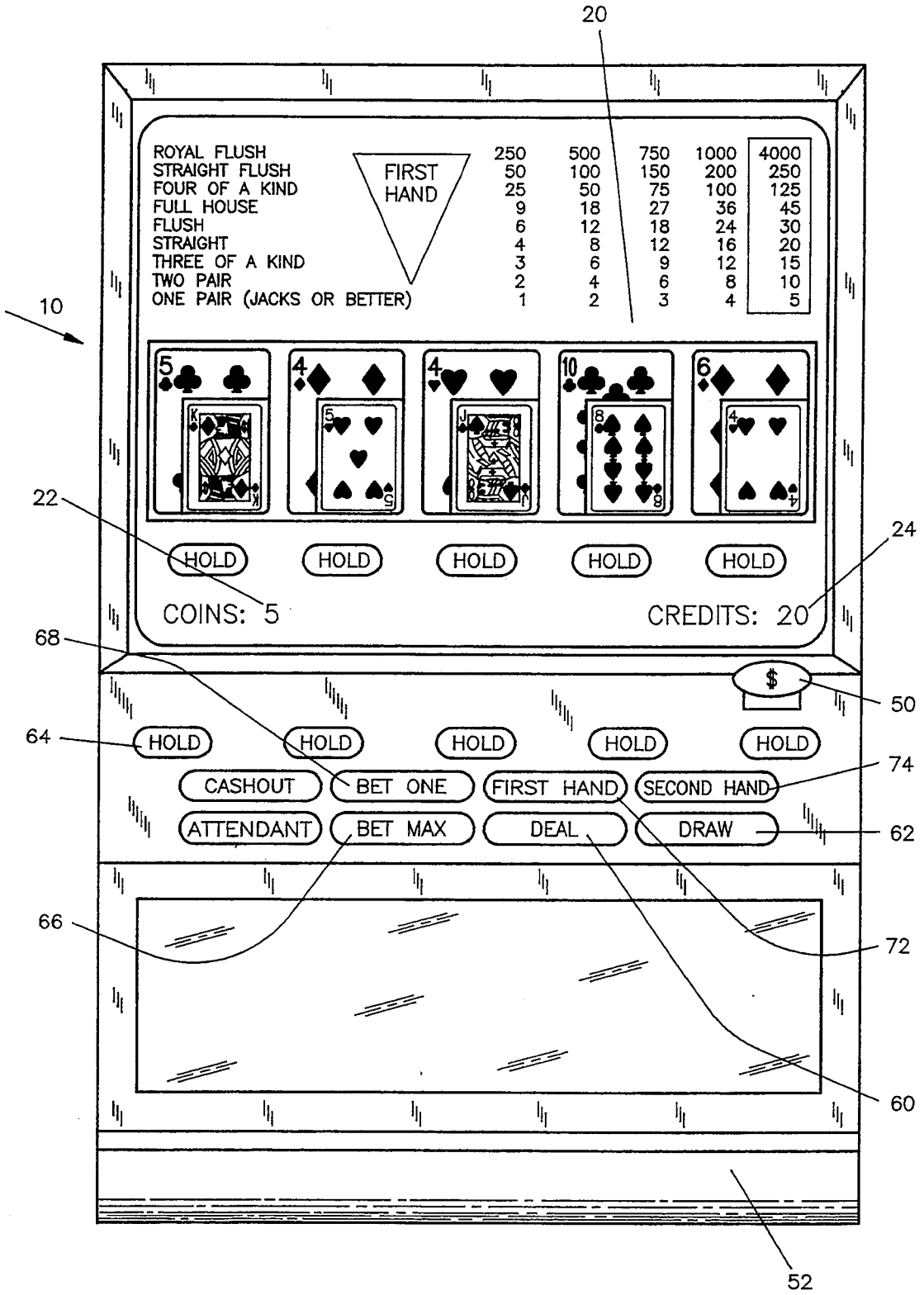
FIG. 1 shows an electronic video gaming machine game of the present invention and upon which the method of the present invention can be played.

FIG. 1 shows an electronic video gaming machine 10 which used to play the electronic version of the present invention. A video display screen 20 displays the player's first hand 100 and the player's second hand 200 as well as other game information. A LED display 22 shows the number of coins wagered by the player for the play of this round of the game. Another LED display shows the number of credits remaining 24 for the player. A single coin entry 50 is provided. Control buttons are provided on the machine to operate the following functions: deal 60, draw 62, cashout 64, bet maximum credits 66 and bet one credit 68. Whenever a player achieves a winning hand, the credits LED display 24 is incremented by the amount that the player has won. The activation of the cashout button 64 causes gaming tokens to be dispensed from a hopper inside the machine (not shown) into the coin tray 52.

To activate the gaming machine, a player places one or more gaming tokens into the coin entry 50 or presses the bet maximum credits button 66 or the bet one credit button 68. If less than the maximum number of credits are played, the player then presses the deal button 60 to deal the cards. As is conventional, if the player wagers the maximum number of credits allowed, the deal is automatically commenced. This activates the electronic controls inside the gaming machine and the player's first five card hand 100 and the player's second five card hand 200 appear on the video display screen 20.

Figure 2:
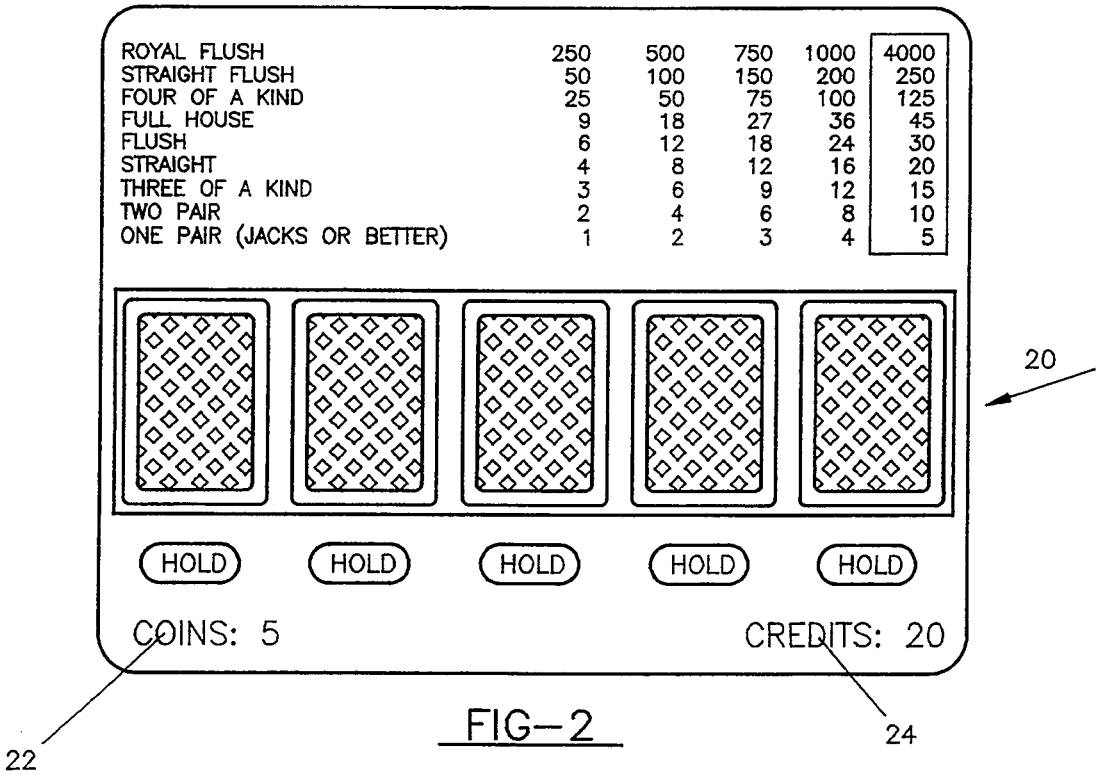
FIG. 2 shows an enlarged view of the display screen of the electronic video poker machine of the present invention just prior to the displaying of the cards.
Figure 3:
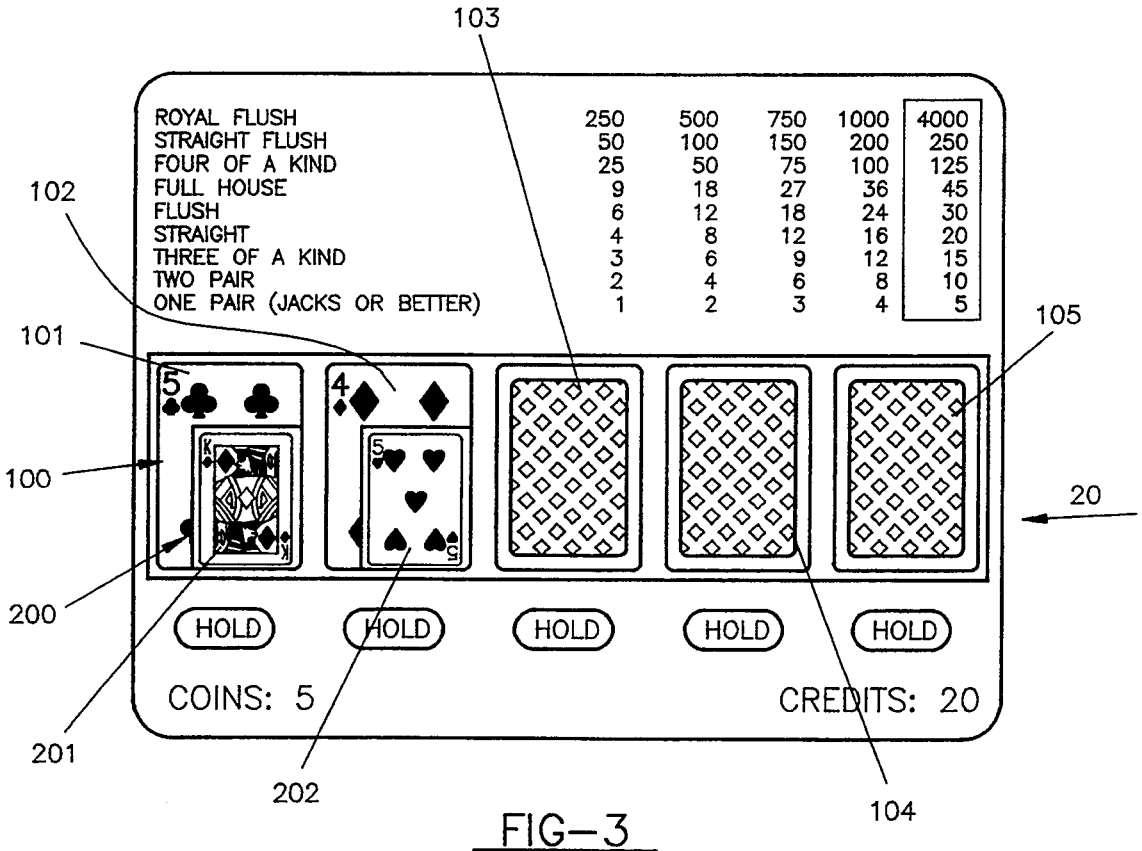
FIG. 3 shows an enlarged view of the display screen of the electronic video poker machine of the present invention as each player's hand is being dealt.

With reference to FIG. 2, just before the cards are dealt, only the back of the playing cards are shown. Referring to FIG. 3, as the deal occurs, the cards are displayed one at a time beginning from the left and progressing to the right across the screen. As shown in FIG. 2, the first card 101 and the second card 102 of the player's first hand 100 and the first card 201 and the second card 202 of the player's second hand 200 have been displayed while the backs of the three remaining cards 103, 104 and 105 are still shown.

The two player's hands 100 and 200 may be displayed in any suitable manner. In the preferred embodiment of the present invention, the cards for the player's second hand 200 are superimposed over a portion of the cards for the player's first hand 100. This saves screen space and makes it relatively easy for the player to compare the first hand 100 to the second hand 200.

Figure 4:
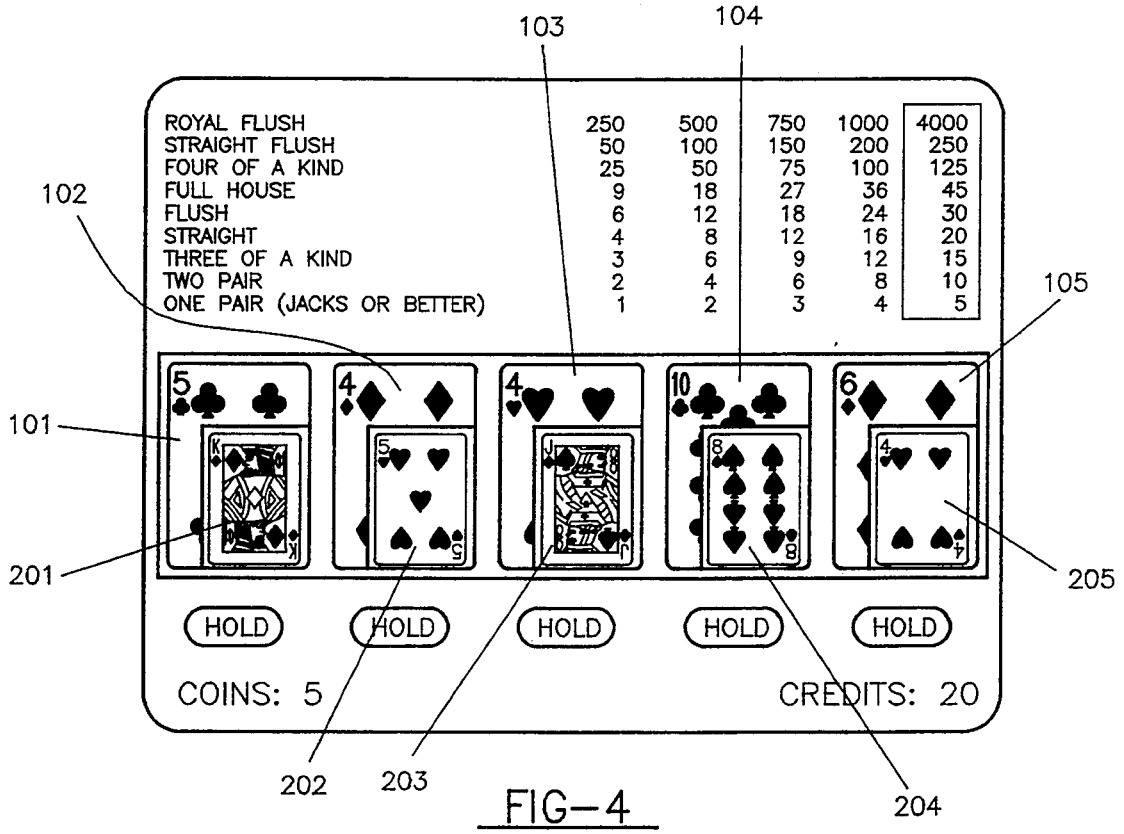
FIG. 4 shows an enlarged view of the display screen of the electronic video poker machine of the present invention after each player's hand has been dealt.

FIG. 4 shows the completion of the initial deal of the player's first hand 100 and the player's second hand 200. The video display screen 20 displays the five cards 101, 102, 103, 104 and 105 of the player's first hand 100 and the five cards 201, 202, 203, 204 and 205 of the player's second hand 200, with the cards for the player's second hand 200 superimposed over the cards for the player's first hand 100. In the preferred embodiment, the cards for the player's second hand 200 are approximately 50% of the size of the cards for the player's first hand 100 when the deal is completed, although the size of the player's second hand 200 can be varied as desired.

Figure 5:
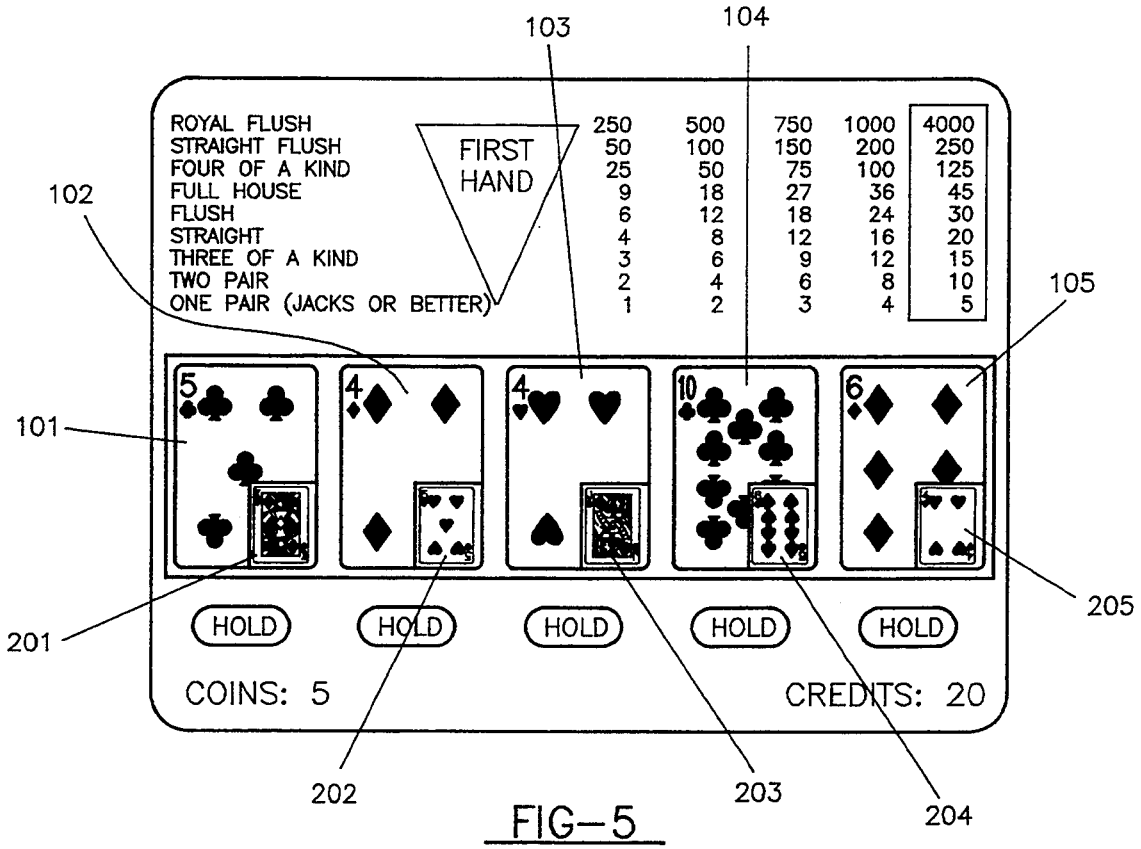
FIG. 5 shows an enlarged view of the display screen of the electronic video poker machine of the present invention with the second player's hand reduced in size.
Figure 6:
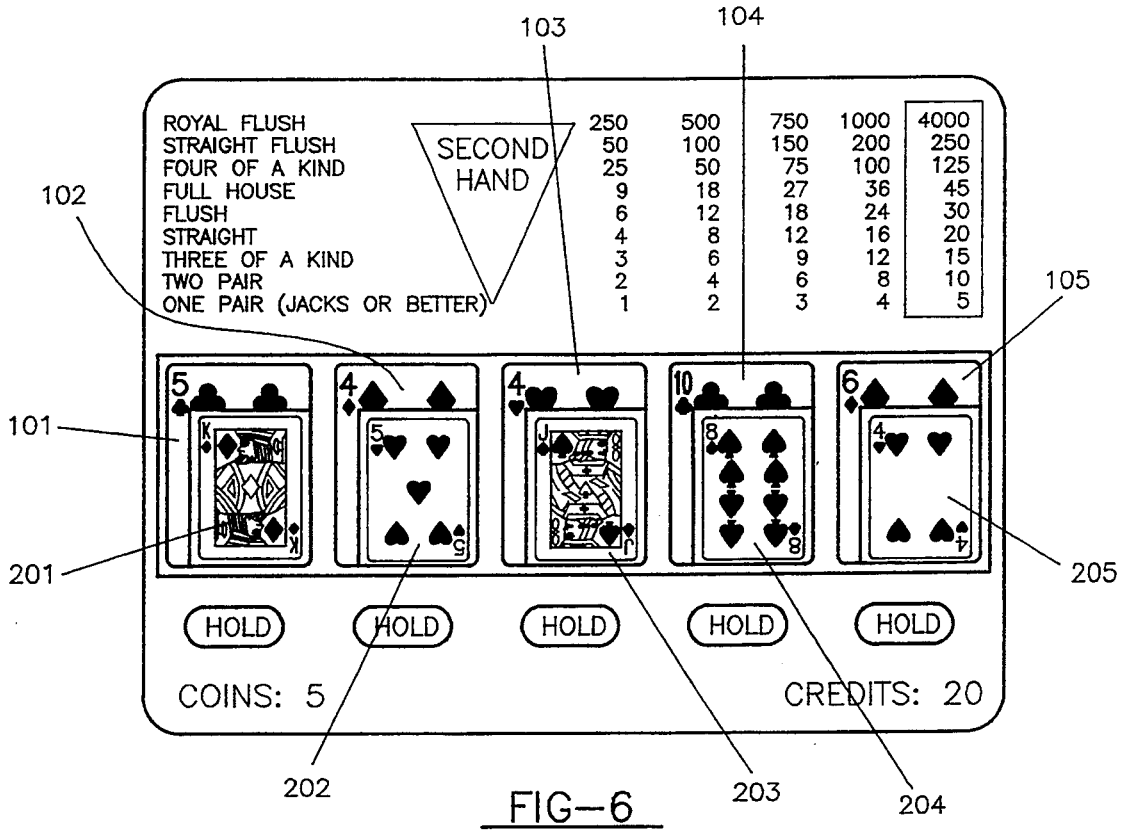
FIG. 6 shows an enlarged view of the display screen of the electronic video poker machine of the present invention with the second player's hand increased in size.
Figure 7:
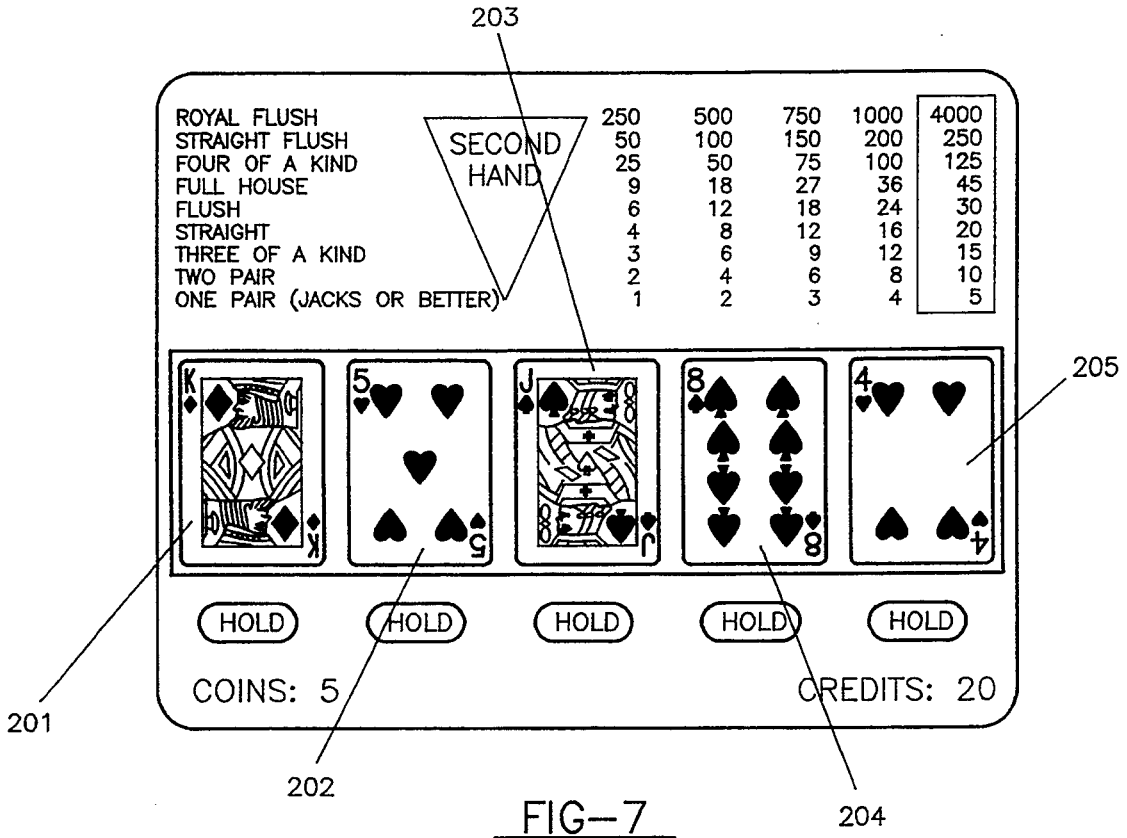
FIG. 7 shows an enlarged view of the display screen of the electronic video poker machine of the present invention with the player having selected to play the player's second hand.
Figure 8:
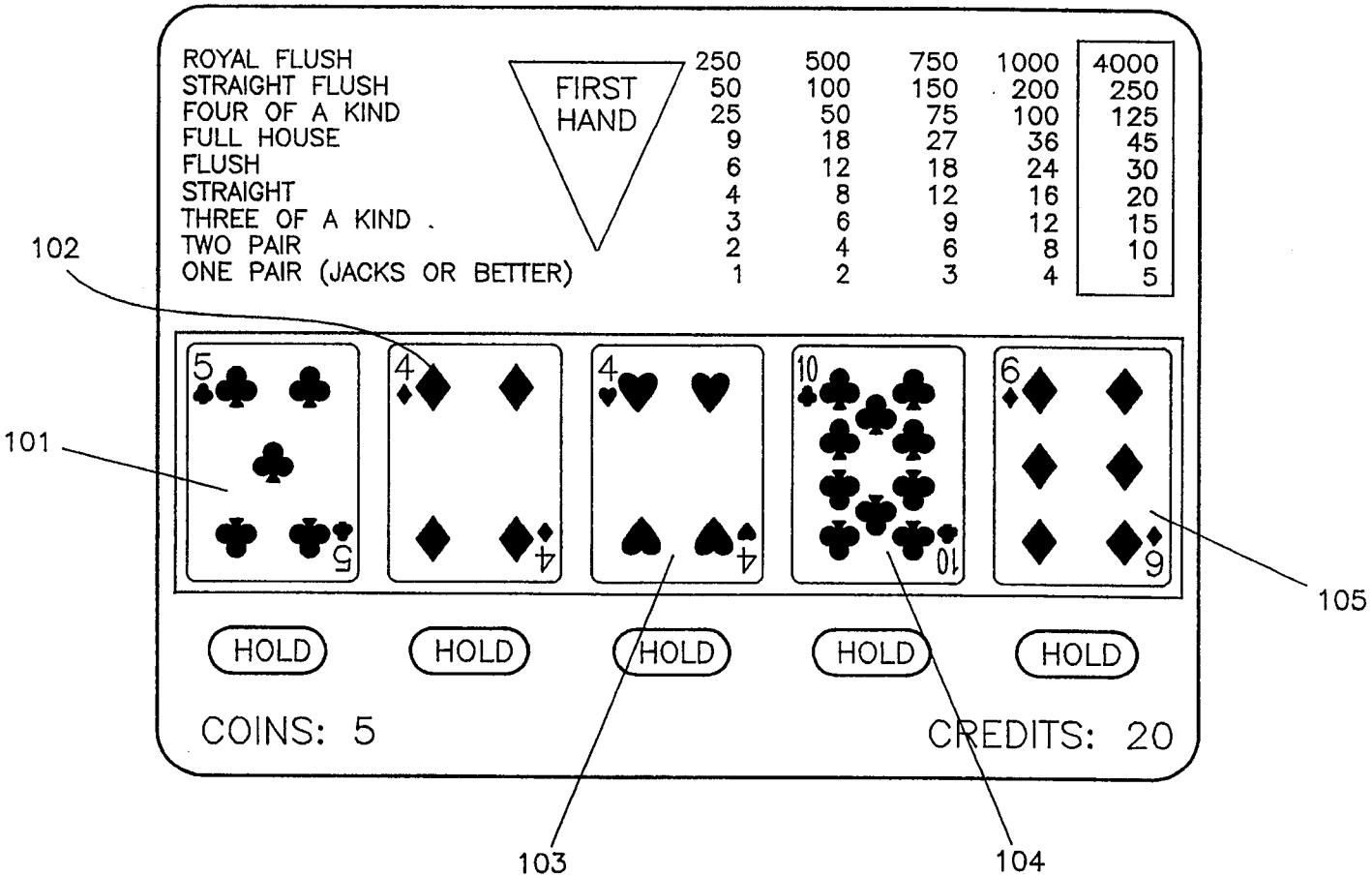
FIG. 8 shows an enlarged view of the display screen of the electronic video poker machine of the present invention with the player having selected to play the player's first hand.

The present invention includes buttons by which the player can increase or decrease the size of the player's second hand 200 to better view either the player's first hand 100 or the player's second hand 200. FIG. 5 shows the player's second hand 200 decreased in size to the point where it is quite small giving an almost unobstructed view of the player's first hand 100. FIG. 6 shows the player's second hand 200 enlarged to the point where it is almost completely obscuring the player's first hand 100 to give the player a good view of the cards forming the player's second hand 200.

Two other buttons are provided for the player to select which of the player's first hand 100 or the player's second hand 200 the player wishes to utilize during the play of the game. When the player pushes the "First Hand" button 72, the cards forming the player's second hand 200 are removed from the display screen 20 and only the player's first hand 100 remain. When the player pushes the "Second Hand" button 74, the cards forming the player's first hand 100 are removed from the screen and only the player's second hand 200 remain.

After the player has selected which hand he wishes to play, the game proceeds in the same manner as conventional video draw poker. The player presses the hold buttons to hold the cards he wishes to keep. The player then presses the draw button 62 and the unheld cards are removed from the display screen 20 and replaced by new cards in a conventional manner. After the draw has occurred, the player is paid an amount based on the number of coins wagered and reflecting whatever winning combination he has achieved according to the payout table at the top of the display screen.

The method and apparatus of the present invention can be applied to other forms of electronic video card games besides draw poker. Deuces Wild draw poker, Joker's Wild draw poker, five card stud poker, seven card stud poker and the like can be structured to deal to the player a first hand from a first deck of cards and a second hand from a Second deck of cards. After the player has selected which hand he wishes to continue playing, the unselected hand is removed from the display screen and the game proceeds in the conventional manner.

An electronic video gaming machine that deals Twenty-One can also be configured using the method and apparatus of the present invention. A first deck of cards is used to deal both the dealer's and the player's first hands. A second distinct deck of cards is used to deal both the dealer's and the player's second hands. Once the player has selected which hand he wishes to play, the unselected hand is removed from the display screen and the play of the game of Twenty-One continues in the conventional manner.

Because the player's first hand 100 is dealt from a first deck of cards and the player's second hand 200 is dealt from a second deck of cards, complete and distinct from the first deck of cards, the theoretical percentages of the game are not affected by giving the player two hands to choose from. The player should perceive, however, that his chances of winning are greater because he has two hands to choose from and this should encourage additional play of electronic video card games. In the Twenty-One version of the present invention, the player's perceived value will be even higher than in poker games because the player can make his selection of which hand to play based not only on the cards in the player's hand but also based on the cards of the dealer's hand.

The conventional manner of play of Twenty-One is as follows: A standard deck of playing cards is used and each card counts its face value, except Aces which have a value of one or eleven as is most beneficial to the count of the hand. Each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has taken additional cards, the dealer then receives his second card.

A player may draw additional cards take ("hits") in order to try and beat the count of the dealer's hand. If the player's count exceeds 21, the player "busts." The player may "stand" on any count of 21 or less. When a player busts, he loses his wager regardless of whether or,not the dealer busts.

After all of the players have taken hits or have stood on their hand, the dealer "stands" or "hits" based on preestablished rules for the game. Typically, if the dealer has less than 17, the dealer must take a hit. If the dealer has 17 or more, the dealer stands.

As the game of Twenty-One is played in most legalized gaming establishments, the conventional manner of play requires the dealer to take a hit whenever the dealer's hand is a "soft 17" count. However in other gaming establishments, the dealer stands on a "soft 17" count. The term "soft" means that the Ace is valued as a count of 1, instead of as a count of 11. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts, the player wins regardless of the numerical count of his hand. If neither the player nor the dealer have busted, the closest hand to a numerical count of 21, without going over, wins; tie hands are a "push."

There are other procedures that are included in the conventional manner of play of Twenty-One. One well-known procedure is "Doubling Down." If the player's first two cards have a combined value of 10 or 11, the player may "double down" on his hand. The player turns both of his cards face-up in front of him and makes a second wager equal to the amount of his initial ante. The dealer deals to the player one additional card and the resulting three card hand establishes the numerical count for the player's hand. The most widely used "Doubling Down" rules permit the player to "double down" only on 10 or 11 counts. Other variations allow players to "double down" on 9, 10 or 11; only on 11; or on any two cards.

Another well-known procedure is "Splitting Pairs." If the player's first two cards are a pair, the player may "split" those cards into two separate hands. His original ante is applied to one of the hands and he makes an additional ante for the other hand. The player receives a new second card for each of the split hands. Each of the split hands is played separately and the player proceeds by standing or taking hits until he has achieved a hand count upon which he wishes to stand or busts.

The player may "double down" on either or both of his split hands if he is eligible to do so under the "Doubling Down" rules. The player may split again if he pairs up on either or both of his split hands. In most gaming establishments, a player may also split his hand if both of his initial cards are ten count cards (Tens, Jacks, queens or Kings). For example, a player can split if he receives a Ten and a Queen, or a Jack and a King, or any combination of ten count cards. Because a hand count of 20 is a good hand to have, most experienced Twenty-One players are reluctant to risk such a hand by "splitting".

Another well-known procedure is "Insurance." If the dealer's up card is an Ace, the player may make an additional "insurance" bet. The insurance bets are made after each player receives his first two cards and the dealer reveals his up card and before any additional cards are dealt. When the dealer's up card is an Ace, each player can wager one-half of the amount of his original ante as insurance against the dealer having a Blackjack, i.e. a two-card 21 count (an Ace and a 10 count card such as a King, Queen, Jack or Ten). If the dealer has a two-card 21 count, the player loses on his original ante but wins two-to-one odds on his second "insurance" bet. Also if the dealer has a two-card 21 count, that round of the game is over and all players lose except those who also have two-card 21 counts who tie or "push" with the dealer. If the dealer does not have a two-card 21 count, the player loses on his "insurance" bet and the round of the game continues.

As used in this disclosure and the accompanying claims, the terms "conventional Twenty-One" and "the conventional manner of play of Twenty-One" mean the game of Twenty-One as previously described and also including any of the known variations of the game of Twenty-One.

As an alternative to superimposing cards of the player's second hand 200 onto the cards of the player's first hand 100, other manners of displaying the player,s first hand 100 and the player's second hand 200 can be used. The player's first hand 100 could be displayed vertically or horizontally next to the player's second hand 200. The player could also be provided with a button that would allow the player to toggle back and forth between the player's first hand 100 and the player's second hand 200, with only one of the player's hands being displayed on the display screen 20 at any one time.

The method and apparatus of the present invention can also be used with a matching feature. Special winning jackpots can be provided if one or more of the cards from the first hand match one or more cards from the second hand at the time of the initial deal of each hand. Odds can be established for matching cards from each hand in the same position in the hand, or in any position in each hand.

EXAMPLE 1

The deal of the first hand can result in the following cards reading left to right: 6 of hearts, 2 of clubs, 7 of spades, 4 of hearts and 9 of diamonds. The deal of the second hand can result in the following cards reading left to right: 6 of hearts, 2 of clubs, 7 of spades, 4 of hearts and 9 of diamonds. In this example, the initial deal of each hand results in identical cards in the identical sequence. Because the odds of this happening are quite high, a large predetermined jackpot amount can be awarded to the player if this should occur.

EXAMPLE 2

The deal of the first hand can result in the following cards reading left to right: 6 of hearts, 2 of clubs, 7 of spades, 4 of hearts and 9 of diamonds. The deal of the second hand can result in the following cards reading left to right: 6 of hearts, 2 of clubs, Ace of hearts, 3 of spades and 9 of diamonds. In this example, the initial deal of each hand results in identical cards appearing in the same card position in the three of the five card positions. A smaller size predetermined jackpot amount can be awarded to the player if this should occur.

Jackpot amounts can be determined for any number of cards being identical in one, two, three, four or five card locations in the first and second hands.

EXAMPLE 3

The deal of the first hand can result in the following cards reading left to right: 6 of hearts, 2 of clubs, 7 of spades, 4 of hearts and 9 of diamonds. The deal of the second hand can result in the following cards reading left to right: 7 of spades, 4 of hearts, 9 of diamonds, 6 of hearts and 2 of clubs. In this example , the initial deal of each hand results in identical cards in different positions appearing in each hand. A predetermined jackpot amount can be awarded to the player if this should occur.

EXAMPLE 4

The deal of the first hand can result in the following cards reading left to right: 6 of hearts, 2 of clubs, 7 of spades, 4 of hearts and 9 of diamonds. The deal of the second hand can result in the following cards reading left to right: 7 of spades, 4 of hearth, 9 of diamonds, Ace of spades and King of hearts. In this example, the initial deal of each hand results in three identical cards in different positions appearing in each hand. A smaller size predetermined jackpot amount can be awarded to the player if this should occur.

Jackpot amounts can be determined for any number of cards being identical in regardless of the card locations in the first and second hands.

Rather than merely paying the player a predetermined amount should a matching feature occur, the method and apparatus can be configured to progressive jackpot meters. For example, five separate progressive jackpot meters can be used corresponding to whether one, two, three, four or five cards are matched between the two hands. The progressive jackpot meters can be started at zero or seeded at an initial jackpot amount. In a conventional manner of other progressive jackpots used on electronic video gaming machines, a portion of each wager made by the player can be designated to each of the progressive jackpot meters which allows the progressive jackpot meters to increase in value. When the player achieves the winning combination, he is paid the amount of the progressive jackpot and the progressive jackpot is reset to the initial starting value.

The matching feature of the present invention and the use of progressive jackpot meters also lends itself to linking a plurality of the gaming machines of the present invention to common progressive jackpot meters so that the value of each of the progressive jackpots will increase more quickly.

The use of the matching feature does not interfere with the normal play of the gaming machine. If the player achieves a match, he is paid the amount of his winnings for the match and the play of the method of the gaming machine continues in the normal way as described above. The matching feature is a separate aspect of the method of play of the invention and does not detract from the normal play of the game; in fact, it adds to the normal play of the game by giving the player an additional opportunity to win.

The method of the present invention can also be applied to a live casino table game using a live dealer.

The dealer would deal to the player the player's first hand from a first deck of cards and the player's second hand from a second deck of cards. After the player has selected which of the player's first hand or the player's second hand the player wishes to play, the dealer would then remove the unselected hand from the table and the game would proceed in the conventional manner. While in theory the game could be played in this live table game manner, the speed of shuffling, dealing and computing winners and losers offered by computers and microchips makes the method of the present invention much more easily adaptable to an electronic video gaming machine.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only the following claims.

What is claimed is:

1. A method of playing a draw poker game comprising:

a) dealing a player a first five card hand from a first deck of playing cards, b) dealing the player a second five card hand from a second deck of playing cards, c) the player selecting either the first hand or the second hand, d) the player either standing on the hand selected or discarding one or more cards from the hand selected, e) dealing the player replacement cards for the discarded cards, if any, f) determining a value for the player's selected hand based on conventional poker hand ranking, and g) awarding the player a predetermined amount based on the value of the player's selected hand.

2. The method of claim 1 in which each deck of playing cards is a standard 52 card deck.

3. The method of claim 1 in which each deck of playing cards is a standard 52 card deck plus at least one extra Joker card which is treated as a wild card.

4. The method of claim 1 in which each deck of playing cards is a standard 52 card deck with at least one of the cards being treated as a wild card.

5. The method of claim 1 in which the value of the player's selected hand is determined by comparing the poker hand ranking of the player's selected hand to a payout schedule.

6. The method of claim 5 in which the predetermined amount based on the value of the player's selected hand is based on a payout schedule.

7. The method of claim 6 in which the payout schedule is as follows:

| | | | | | |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

8. A method of playing a draw poker game comprising:

a) a player wagering at least one coin to be eligible to participate in the game, b) dealing the player a first five card hand from a first deck of playing cards, c) dealing the player a second five card hand from a second deck of playing cards, d) the player selecting either the first hand or the second hand, e) the player either standing on the hand selected or discarding one or more cards from the hand selected, f) dealing the player replacement cards for the discarded cards, if any, g) determining a value for the player's selected hand based on conventional poker hand ranking, and h) paying the player a predetermined amount of coins based on the value of the player's selected hand.

9. The method of claim 8 in which each deck of playing cards is a standard 52 card deck.

10. The method of claim 8 in which each deck of playing cards is a standard 52 card deck plus at least one extra Joker card which is treated as a wild card.

11. The method of claim 8 in which each deck of playing cards is a standard 52 card deck with at least one of the cards being treated as a wild card.

12. The method of claim 8 in which the value of the player's selected hand is determined by comparing the poker hand ranking of the player's selected hand to a payout schedule.

13. The method of claim 12 in which the predetermined amount based on the value of the player's selected hand is based on a payout schedule.

14. The method of claim 13 in which the payout schedule is as follows:

| | | | | | |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

15. The method of claim 8 in which the amount that the player is paid is based on the number of coins wagered by the player.

16. A method of playing a draw poker game on an electronic gaming machine comprising:

a) electronically displaying to a player a first five card hand from a first deck of playing cards, b) electronically displaying to the player a second five card hand from a second deck of playing cards, c) the player selecting either the first hand or the second hand, d) the player either standing on the hand selected or discarding one or more cards from the hand selected, e) electronically displaying to the player replacement cards for the discarded cards, if any, f) electronically determining a value for the player's selected hand based on conventional poker hand ranking, and g) awarding the player a predetermined amount based on the value of the player's selected hand.

17. The method of claim 16 in which each deck of playing cards is a standard 52 card deck.

18. The method of claim 16 in which each deck of playing cards is a standard 52 card deck plus at least one extra Joker card which is treated as a wild card.

19. The method of claim 16 in which each deck of playing cards is a standard 52 card deck with at least one of the cards being treated as a wild card.

20. The method of claim 16 in which the value of the player's selected hand is determined by electronically comparing the poker hand ranking of the player's selected hand to a payout schedule.

21. The method of claim 20 in which the predetermined amount based on the value of the player's selected hand is based on a payout schedule.

22. The method of claim 21 in which the payout schedule is as follows:

| | | | | | |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

23. The method of claim 16 in which the player is awarded by accruing credits on a credit meter displayed on the gaming machine.

24. A method of playing a draw poker game on an electronic gaming machine comprising:

a) a player wagering at least one coin, b) electronically displaying to the player a first five card hand from a first deck of playing cards, c) electronically displaying to the player a second five card hand from a second deck of playing cards, d) the player selecting either the first hand or the second hand, e) the player either standing on the hand selected or discarding one or more cards from the hand selected, f) electronically displaying to the player replacement cards for the discarded cards, if any, g) electronically determining a value for the player's selected hand based on conventional poker hand ranking, and h) paying the player a predetermined amount of coins based on the value of the player's selected hand.

25. The method of claim 24 in which each deck of playing cards is a standard 52 card deck.

26. The method of claim 24 in which each deck of playing cards is a standard 52 card deck plus at least one extra Joker card which is treated as a wild card.

27. The method of claim 24 in which each deck of playing cards is a standard 52 card deck with at least one of the cards being treated as a wild card.

28. The method of claim 24 in which the value of the player's selected hand is determined by electronically comparing the poker hand ranking of the player's selected hand to a payout schedule.

29. The method of claim 28 in which the predetermined amount based on the value of the player's selected hand is based on a payout schedule.

30. The method of claim 29 in which the payout schedule is as follows:

| | | | | | |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

31. The method of claim 24 in which the amount that the player is paid is based on the number of coins wagered by the player.

32. The method of claim 24 in which the player wagers at least one coin by inserting a coin into a coin entry on the gaming machine.

33. The method of claim 24 in which the player wagers at least one coin by activating a button that deducts a credit from a credit meter displayed on the gaming machine.

34. The method of claim 24 in which the player in which the player is paid by dispensing coins from a coin hopper of the gaming machine.

35. The method of claim 24 in which the player is paid by accruing credits on a credit meter displayed on the gaming machine.

36. A method of playing a stud poker game comprising:

a) dealing the player a first hand of cards from a first deck of playing cards, the first hand comprising less than a complete stud poker hand, b) dealing the player a second hand of cards from a second deck of playing cards, the second hand comprising less than a complete stud poker hand, c) the player selecting either the first hand or the second hand, d) dealing the player additional cards to complete the hand selected, e) determining a value for the player's completed selected hand based on conventional poker hand ranking, and f) awarding the player a predetermined amount based on the value of the player's completed selected hand.

37. The method of claim 36 in which the value of the player's completed selected hand is determined by comparing the poker hand ranking of the player's completed selected hand to a payout schedule.

38. The method of claim 37 in which the predetermined amount based on the value of the player's completed selected hand is based on a payout schedule.

39. A method of playing a stud poker game comprising:

a) a player wagering at least one coin, b) dealing the player a first partial hand of cards from a first deck of playing cards, the first partial hand comprising less than a complete stud poker hand, c) dealing the player a second partial hand of cards from a second deck of playing cards, the second partial hand comprising less than a complete stud poker hand, d) the player selecting either the first partial hand or the second partial hand, e) dealing the player additional cards to complete the hand selected, f) determining a value for the player's completed selected hand based on conventional poker hand ranking, and h) paying the player a predetermined amount of coins based on the value of the player's completed selected hand.

40. The method of claim 39 in which the value of the player's completed selected hand is determined by comparing the poker hand ranking of the player's completed selected hand to a payout schedule.

41. The method of claim 40 in which the predetermined amount based on the value of the player's completed selected hand is based on a payout schedule.

42. A method of playing a stud poker game on an electronic gaming machine comprising:

a) electronically displaying to a player a first partial hand of cards from a first deck of playing cards, the first partial hand comprising less than a complete stud poker hand, b) electronically displaying to the player a second partial hand of cards from a second deck of playing cards, the second partial hand comprising less than a complete stud poker hand, c) the player selecting either the first partial hand or the second partial hand, d) electronically displaying to the player additional cards to complete the hand selected, e) electronically determining a value for the player's completed selected hand based on conventional poker hand ranking, and f) awarding the player a predetermined amount based on the value of the player's completed selected hand.

43. The method of claim 42 in which the value of the player's selected hand is determined by electronically comparing the poker hand ranking of the player's selected hand to a payout schedule.

44. The method of claim 43 in which the predetermined amount based on the value of the player's selected hand is based on a payout schedule.

45. A method of playing a stud poker game on an electronic gaming machine comprising:

a) a player wagering at least one coin, b) electronically displaying to a player a first partial hand of cards from a first deck of playing cards, the first partial hand comprising less than a complete stud poker hand, c) electronically displaying to the player a second partial hand of cards from a second deck of playing cards, the second partial hand comprising less than a complete stud poker hand, d) the player selecting either the first partial hand or the second partial hand, e) electronically displaying to the player additional cards to complete the hand selected, f) electronically determining a value for the player's completed selected hand based on conventional poker hand ranking, and h) paying the player a predetermined amount of coins based on the value of the player's completed selected hand.

46. The method of claim 45 in which the value of the player's selected hand is determined by electronically comparing the poker hand ranking of the player's selected hand to a payout schedule.

47. The method of claim 46 in which the predetermined amount based on the value of the player's selected hand is based on a payout schedule.

48. A method of playing a Twenty-One game comprising:

a) dealing a first Twenty-One hand comprising two cards to a player representing the player's first hand and at least one card to a dealer representing the dealer's first hand, one card of the dealer's first hand being dealt face-up, from a first deck of playing cards, b) dealing a second Twenty-One hand comprising two cards to the player representing the player's second hand and at least one card to the dealer representing the dealer's second hand, one card of the dealer's first hand being dealt face-up, from a second deck of playing cards, c) the player selecting either the first Twenty-One hand or the second Twenty-One hand, d) the player standing or receiving additional cards for the player's selected hand as the player desires in accordance with the conventional manner of play of Twenty-One, e) the dealer standing or receiving additional cards as part of the dealer's selected hand in accordance with the conventional manner of play of Twenty-One, f) comparing the dealer's selected hand to the player's selected hand in accordance with the conventional manner of play of Twenty-One, g) awarding the player a predetermined amount if the player's selected hand beats the dealer's selected hand in accordance with the conventional manner of play of Twenty-One.

49. A method of playing a Twenty-One game comprising:

a) a player wagering at least one coin b) dealing a first Twenty-One hand comprising two cards to a player representing the player's first hand and at least one card to a dealer representing the dealer's first hand, one card of the dealer's first hand being dealt face-up, from a first deck of playing cards, c) dealing a second Twenty-One hand comprising two cards to the player representing the player's second hand and at least one card to the dealer representing the dealer's second hand, one card of the dealer's first hand being dealt face-up, from a second deck of playing cards, d) the player selecting either the first Twenty-One hand or the second Twenty-One hand, e) the player standing or receiving additional cards for the player's selected hand as the player desires in accordance with the conventional manner of play of Twenty-One, f) the dealer standing or receiving additional cards as part of the dealer's selected hand in accordance with the conventional manner of play of Twenty-One, g) comparing the dealer's selected hand to the player's selected hand in accordance with the conventional manner of play of Twenty-One, and h) paying the player a predetermined amount if the player's selected hand beats the dealer's selected hand in accordance with the conventional manner of play of Twenty-One.

50. A method of playing a Twenty-One game on an electronic gaming machine comprising:

a) electronically displaying a first Twenty-One hand comprising two cards representing a player's first hand and at least one card representing a dealer's first hand, one card of the dealer's first hand being dealt face-up, from a first deck of playing cards, b) electronically displaying a second Twenty-One hand comprising two cards representing the player's second hand and at least one card representing the dealer's second hand, one card of the dealer's first hand being dealt face-up, from a second deck of playing cards, c) the player selecting either the first Twenty-One hand or the second Twenty-One hand, d) the player standing or receiving additional cards for the player's selected hand as the player desires in accordance with the conventional manner of play of Twenty-One, e) the dealer standing or receiving additional cards as part of the dealer's selected hand in accordance with the conventional manner of play of Twenty-One, f) electronically comparing the dealer's selected hand to the player's selected hand in accordance with the conventional manner of play of Twenty-One, g) awarding the player a predetermined amount if the player's selected hand beats the dealer's selected hand in accordance with the conventional manner of play of Twenty-One.

51. A method of playing a Twenty-One game on an electronic gaming machine comprising:

a) a player wagering at least one coin, b) electronically displaying a first Twenty-One hand comprising two cards to a player representing the player's first hand and at least one card to a dealer representing the dealer's first hand, one card of the dealer's first hand being dealt face-up, from a first deck of playing cards, c) electronically displaying a second Twenty-One hand comprising two cards to the player representing the player's second hand and at least one card to the dealer representing the dealer's second hand, one card of the dealer's first hand being dealt face-up, from a second deck of playing cards, d) the player selecting either the first Twenty-One hand or the second Twenty-One hand, e) the player standing or receiving additional cards for the player's selected hand as the player desires in accordance with the conventional manner of play of Twenty-One, f) the dealer standing or receiving additional cards as part of the dealer's selected hand in accordance with the conventional manner of play of Twenty-One, g) electronically comparing the dealer's selected hand to the player's selected hand in accordance with the conventional manner of play of Twenty-One, and h) paying the player a predetermined amount if the player's selected hand beats the dealer's selected hand in accordance with the conventional manner of play of Twenty-One.

* * * * *